US010500621B2

(12) United States Patent
Weisshaar

(10) Patent No.: US 10,500,621 B2
(45) Date of Patent: Dec. 10, 2019

(54) METHOD FOR PROCESSING MATERIAL TO BE ROLLED ON A ROLLING LINE, AND ROLLING LINE

(71) Applicant: PRIMETALS TECHNOLOGIES GERMANY GMBH, Erlangen (DE)

(72) Inventor: Bernhard Weisshaar, Herzogenaurach (DE)

(73) Assignee: PRIMETALS TECHNOLOGIES GERMANY GMBH (DE)

( * ) Notice: Subject to any disclaimer, the term of this patent is extended or adjusted under 35 U.S.C. 154(b) by 552 days.

(21) Appl. No.: 14/913,752

(22) PCT Filed: Aug. 19, 2014

(86) PCT No.: PCT/EP2014/067669
§ 371 (c)(1),
(2) Date: Feb. 23, 2016

(87) PCT Pub. No.: WO2015/024941
PCT Pub. Date: Feb. 26, 2015

(65) Prior Publication Data

US 2016/0214153 A1 Jul. 28, 2016

(30) Foreign Application Priority Data

Aug. 23, 2013 (EP) ..... 13181568

(51) Int. Cl.
*B21D 37/00* (2006.01)
*B21B 37/46* (2006.01)
*B21B 37/52* (2006.01)

(52) U.S. Cl.
CPC ..... *B21B 37/46* (2013.01); *B21B 37/52* (2013.01)

(58) Field of Classification Search
CPC ..... B21B 37/46; B21B 38/08; B21B 2275/02; B21B 2275/04
See application file for complete search history.

(56) References Cited

U.S. PATENT DOCUMENTS 4,460,852 A 7/1984 Kondo et al.
4,506,197 A 3/1985 Kondo et al.
(Continued)

FOREIGN PATENT DOCUMENTS

CN 1803326 A 7/2006
CN 101328842 A 12/2008
(Continued)

OTHER PUBLICATIONS

International Search Report dated Feb. 5, 2015 issued in corresponding International patent application No. PCT/EP2014/067669.
(Continued)

*Primary Examiner* — Debra M Sullivan
(74) *Attorney, Agent, or Firm* — Ostrolenk Faber LLP

(57) ABSTRACT

A method for machining rolled stock (6) in a rolling train (2), the train including at least one rolling block (20, 20*a*, 20*b*) having at least two rolling stands (4) with each stand including at least one roll (13). Each rolling stand (4) has a separate drive (8) with a speed controller (14) for its roll (13). A time ($t_{zw}$) that is dependent on the point in time (tB) that an actual loading moment is applied to the drive (8) of the first rolling stand (4) of the rolling block (20, 20*a*, 20*b*), for controlling the speed of the drive (8). An additional value (ZW), dependent on an expected actual loading moment, is fed to the speed controller (14) of each drive (8). Also, a rolling train (2) for machining rolled stock (6), is disclosed having the features above and having an open-loop/closed-loop control unit (24), in which software for the method is implemented.

8 Claims, 2 Drawing Sheets

(56) References Cited

U.S. PATENT DOCUMENTS

| | | | | |
|---|---|---|---|---|
| 6,311,532 | B1 * | 11/2001 | Ballheimer | B21B 37/46<br>72/10.3 |
| 2008/0312807 | A1 | 12/2008 | Dolker | 701/103 |
| 2012/0126882 | A1 | 5/2012 | Bevot et al. | 327/553 |
| 2012/0216588 | A1 * | 8/2012 | Klingen | B21B 35/04<br>72/234 |

FOREIGN PATENT DOCUMENTS

| | | | |
|---|---|---|---|
| CN | 102467146 | A | 5/2012 |
| CN | 103141161 | A | 6/2013 |
| DE | 24 13 492 | A1 | 10/1975 |
| DE | 197 26 586 | A1 | 1/1999 |
| GB | 800109 | A | 8/1958 |
| JP | S55-149714 | A | 11/1980 |
| JP | S57-130713 | A | 8/1982 |
| KR | 10-20040040774 | A | 5/2004 |
| WO | WO 2012/014026 | A1 | 2/2012 |

OTHER PUBLICATIONS

Written Opinion dated Feb. 5 2015 issued in corresponding International patent application No. PCT/EP2014/067669.

First Office Action with Search Report dated Dec. 19, 2016 in corresponding Chinese Patent Application No. 201480046711.0 (with English language translation)(total 19 pages).

* cited by examiner

METHOD FOR PROCESSING MATERIAL TO BE ROLLED ON A ROLLING LINE, AND ROLLING LINE

CROSS-REFERENCE TO RELATED APPLICATIONS

The present application is a 35 U.S.C. §§ 371 national phase conversion of PCT/EP2014/067669, filed Aug. 19, 2014, which claims priority of European Patent Application No. 13181568.0, filed Aug. 23, 2013, the contents of which are incorporated by reference herein. The PCT International Application was published in the German language.

The invention relates to a method for the processing of material, particularly steel or another metal to be rolled on a rolling line with at least two roll stands each having at least one roll. A separate drive is assigned to each roll stand for its at least one roll, and a rolling line.

TECHNICAL BACKGROUND

In the processing of rolled materials, e.g. steel or various metals, which are in the form of so-called slabs or billets, the material being rolled passes along a rolling line with several rolling sections. The sections for example include a roughing, an intermediate and a finishing section. In turn, each of the rolling sections incorporates several roll stands, in which the material to be rolled is rolled out in several passes to form strips or wire. In the case of wire rolling, the roll stands used have rolls, each having two calibrated rolling rings, one above another, with bores which are alternately round and oval in shape, the cross-section of which decreases after each pass. Thus, from billets with an approximately square cross-section, round wire is manufactured.

In order to roll the material which is being rolled down to the desired cross-section at each roll stand, the rotational speeds of the rolls of the individual roll stands must be regulated to a set rotational speed value. The individual set rotational speed values, and hence also the ratios to each other of the rotational speeds of the rolls in the successive roll stands, are generally prescribed in a pass plan. In order to obtain, at the end of the rolling line, the desired thickness or the desired cross-section of the processed rolled material, the prescribed ratios of rotational speeds must be adhered to as closely as possible during the processing, i.e. the actual values of the rotational speeds of the rolls in the successive roll stands must also at all times correspond to the prescribed rotational speed ratio.

In particular during wire rolling, very high roll speeds arise, so that the pass offtakes and the ratios of the rotational speeds of the rolls in the individual roll stands must be precisely matched to each other and kept constant in order to avoid tension and compression loads on the wire between the roll stands. Even small deviations can lead to a breakage of the wire or to loop formation.

One possibility for ensuring that the rotational speed ratio is kept constant is to couple all the roll stands in a rolling section together rigidly via a mechanical transfer gearbox and to drive them by a common large motor. However, a major disadvantage of this is that, for example, if there is wear in the individual rolling rings, it is always necessary to exchange or to regrind all the rolling rings, because the cross-sections or diameters of the bores must be matched to one another in order to achieve a desired result from the rolling. This makes such an approach very time-consuming and costly.

These disadvantages can be overcome in that each roll stand of the rolling section is driven by a separate drive, that is with its own motor and gearbox. This permits the rolling speeds to be set for the rolls in each roll stand independently of each other by means of set rotational speed values for the individual drives, which can be adjusted by means of a rotational speed regulator provided for each drive. Wear of individual rolls or pairs of rolling rings can then be balanced out by a change in the set rotational speed value, in order to achieve the required rolling speed of the drive concerned. In addition, there is no need for a mechanical transfer gearbox, the design of which is demanding.

However, a major challenge of such a drive solution is presented by the regulation of the rotational speed of the individual roll stands during the processing of goods which are being rolled. When a roll stand is broached, i.e. when the goods being rolled first enter the rolls, a real load moment is imposed on them which effects a drop in the rotational speed of the rolls in this roll stand. On the other hand the rolls in the other roll stands, on which at the time point of the broaching there is no real load moment or a different one, e.g. a smaller one, have an unchanged or only slightly altered rotational speed. The consequence of this is that the rotational speeds of the individual drives or rolls are no longer working in synchrony, that is no longer in a prescribed rotational speed ratio to one another. This can lead to tension or compression loads, and hence a breakage of the wire, or to the material being rolled forming loops between the individual roll stands.

There is a known method as to how the rotational speeds of all the stands within a finishing section can be kept constant relative to one another after the imposition of real load moments, arising when material enters into the rolling gap, and tension or compression loads on the wire are thus avoided.

However, in particular if loop formation between the intermediate and finishing sections must not be permitted to occur, i.e. if the rotational speeds of the stands in the finishing section must also remain constant relative to the rotational speed of the last stand in the intermediate section, the method cited above is not adequate. Material entering into the first stand of the finishing section would, due to the real load moment, produce a drop in the rotational speed of the first stand, and the existing prescription would then ensure that the rotational speeds of the remaining stands in the finishing section would remain in step with this drop in rotational speed, that is they would remain synchronous. By comparison with the last stand in the intermediate section however, an impermissible asynchronicity in the rotational speeds would result. The existing method must therefore be supplemented by a further method in accordance with the invention.

From DE 197 26 586 A1, a method and equipment are known for the purpose of reducing or compensating drops in the rotational speed when goods which are being rolled are threaded into a roll stand. In this method, the rotational speed of the rolls in the roll stand are regulated by a regulator wherein, independently of its input, the regulator issues a predefined supplementary value in a prescribed transitional time interval, shortly before the material being rolled is threaded into the roll stand, when it is being threaded in, or shortly after it has been threaded in.

In DE 24 13 492 A1, a method and a circuit arrangement are described for the mutual matching of the drive rotational speeds in a multi-stand rolling line with individual drives. In this method for the mutual matching of the rotational speeds of the drives in successive stands of a continuous rolling line with individual drives, each of which is regulated to a set rotational speed value by a rotational speed regulation loop with an underlying moment regulation loop, when a stand is broached the change in the drive moment at the preceding stand is detected, the rotational speed regulation loop of the stand which is being broached is isolated and the underlying moment regulation loop is switched over to an artificial moment setpoint value which is formed from a prescribed value and a correction value derived from the change in the drive moment at the preceding stand. After a predefined time span—at the latest when the next-following stand is broached—the instantaneous value of the drive rotational speed is issued to the rotational speed regulation loop as an improved rotational speed setpoint value, and the rotational speed regulation loop is smoothly re-engaged.

SUMMARY OF THE INVENTION

It is the objective of the invention to specify a method for the processing of rolled goods in which the disadvantages cited above are avoided. It is also the objective of the invention to specify a rolling line for carrying out the method.

The first-mentioned objective is achieved by the inventive method for the processing of material to be rolled on a rolling line. The rolling line incorporates at least one rolling section which has at least two roll stands, each with at least one roll. Each roll stand has assigned to it a separate drive with a rotational speed regulator for the at least one roll, for the purpose of regulating the rotational speeds of the drives. A supplementary value, which depends on an expected real load moment, is fed to the rotational speed regulator of each drive at a point in time which depends on the time point at which a real load moment is imposed on the drive for the first roll stand in the rolling section. The supplementary value is fed simultaneously to the rotational speed regulator of the drive for the first roll stand and to the rotational speed regulators of the drives of the following roll stands in the same rolling section.

In other words: at the point in time when the first roll stand in a rolling section is broached, that is the point in time at which the material being rolled enters into the first roll stand of a rolling section, e.g. the finishing section, this first roll stand has a real load moment imposed on it. The point in time of the imposition is thus the point in time when the material being rolled enters into the roll stand, so that a real load moment is exerted on this roll stand. At another, appropriate time point, shortly before, simultaneous with or shortly after the point in time when a real load moment is imposed on the first roll stand, a supplementary value, e.g. a torque value, is fed simultaneously to the rotational speed regulator of the drive for the first roll stand and to each of the rotational speed regulators of the drives for the following roll stands in the same rolling section, that is for example to all the further roll stands in the finishing section. Here, the point in time for feeding the supplementary value concerned is chosen, depending on the time point when the load is imposed, in such a way that the rotational speed regulator of the roll stand concerned compensates for the real load moment and thus prevents, or at least largely compensates for, a drop in the rotational speed there. Because system-specific delays arise on a rolling line, the supplementary value will ideally be fed at a point in time, which depends on the time point when the load is imposed, such that a corresponding torque, prompted by the supplementary value, is produced by the drive at the point in time when the real load moment arises. Here, the supplementary value will be determined for each rotational speed regulator of each drive as a function of the expected real load moment, that is the real load moment which is expected to arise at the first roll stand when the material being rolled enters it, and will be fed to the rotational speed regulator concerned at the point in time when the load is imposed.

Thus, at the point in time when the first roll stand is broached, all the rotational speed regulators of all the drives in a rolling section are simultaneously preloaded with the supplementary value to ensure simultaneous anticipatory control of the roll rotational speeds for all the roll stands, and hence a balanced running of all the drives. Here, pre-loading is to be understood as meaning that the initial value of the rotational speed regulator is set to a non-zero initial value, in order to achieve a more rapid reaction from the rotational speed regulator to a drop in rotational speed. Thus all the rotational speed regulators of all the drives in the rolling section are simultaneously subjected to the relevant supplementary value, at a point in time shortly before, simultaneous with or shortly after the point in time at which the first roll stand has a real load moment imposed on it, that is at a point in time which depends on the point in time of that imposition. By this means, on the one hand the drop in rotational speed at the first roll stand, determined by the imposition on the drive of a real load moment, is largely compensated for, or at least reduced, and loop formation before the first roll stand in a rolling section is prevented.

However because, in accordance with the invention, the supplementary value is fed not only to the rotational speed regulator for the first roll stand or the first drive, as applicable, which has the real load moment imposed on it, but also to the rotational speed regulator for each drive of each roll stand in the rolling section, not only is the drop in rotational speed reduced, at the drive on which the real load moment is imposed, but also the ratios of the rotational speeds of the roll stands in a rolling section are maintained relative to one another. By feeding the relevant supplementary value into all the rotational speed regulators, a drop in rotational speed is prevented, or a brief change in the rotational speed is effected, at all the drives. The advantage of this is both that loop formation before the first roll stand is prevented and also synchronicity of the individual roll stands to one another, that is rotational speed ratios in conformity with the pass plan, is maintained, and thereby loop formation or breakage of the wire between the individual roll stands in the rolling section is prevented.

The rotational speed regulators of the drives can incorporate various regulators, e.g. P- or PI-regulators, to which the supplementary value can be fed. However, with one preferred embodiment of the invention, the supplementary value concerned is fed to a rotational speed regulator, which incorporates a PI regulator, as the preloading value for an I-component. Here, the preloading of an I-component is to be understood as meaning that the I-component of the rotational speed regulator is set to a non-zero initial value, in order to achieve a faster reaction by the rotational speed regulator to a drop in rotational speed. Unlike a supplementary value which is additive to the starting magnitude, the preloading of the I-component of the rotational speed regulator has the advantage that the supplementary value must not be "switched off" again, but is autonomously phased out by the rotational speed regulator. An autonomous correction of the rotational speed regulator is thus effected in that the supplementary value is smoothed out by reference to a comparison of the set-point and actual values of the rotational speed.

With one preferred form of embodiment, the expected real load moment and the relevant supplementary value are determined by reference to a pass plan. Such a pass plan defines, for example, the thickness to which the material being rolled should be rolled down in the individual roll stands, and what rotational speed set-point values must be set for this purpose. From this it is then possible to determine load moments which are to be expected at the individual roll stands. In order to reduce the drop in rotational speed when a drive has a real load moment imposed on it, in the pass plan the relevant supplementary values are determined from the expected real load moments which have been determined, and are fed to the relevant rotational speed regulator. This is advantageous, in particular, if no measured values are yet available for real load moments which arise, that is for example when processing starts.

In principle it is possible to determine the time point of the imposition of the load on the first roll stand in a rolling section by reference to various measured values. With one advantageous form of embodiment of the method, the point in time at which the real load moment is imposed on the drive of the first roll stand is determined by reference to a measurement of a rolling force. The entry of the material being rolled into the first roll stand, that is the imposition of a real load moment on the first roll stand, produces an almost step-like load on the drive of the first roll stand, so that the time point when the load is imposed, that is the time point of the broaching, can be detected by means of a measurement of the rolling force at the first roll stand.

Here, such a measurement of the rolling force is effected, in particular, with a strain gauge, for example integrated into a base plate of the first roll stand. Although one does not thereby obtain an exact value for the rolling force, for the purpose of determining the time point of the imposition of the load a value proportional to the rolling force is however sufficient. If this value exceeds a threshold value, this is taken to be an indicator of an imposition of the load on the drive, that is the entry of the goods being rolled into the roll stand. The point in time at which this threshold value is exceeded is thus regarded as the point in time at which a real load moment is imposed on the first roll stand. The feed of the relevant supplementary value is then effected shortly after the point in time of the load imposition, and the drop in rotational speed is reduced.

A further preferred possibility consists in determining the point in time at which a real load moment is imposed on the drive of the first roll stand by reference to material tracking of the material being rolled. This can be effected, for example, by reference to model-based material tracking. Another possibility is the use for the purpose of material tracking of so-called "hot metal detectors", arranged for example before the first roll stand in a rolling section. Such detectors incorporate, among other items, a light barrier, by which it is possible to capture the point in time at which the front end of the material being rolled, such as for example the tip of the wire, passes the detector. If the position of the detector relative to the first roll stand, or the travel time of the material being rolled up to the first roll stand, or the speed of the material being rolled, is known, it is possible from this to determine the point in time at which the load is imposed.

In order to be able to determine as exactly as possible the point in time at which the supplementary value should be fed, as a function of the point in time at which the first real load moment is imposed, the invention takes into account, for example, delays which occur in determining the point in time at which the load is imposed. One such delay might be, for example, the response time of the light barriers mentioned previously, which is then included in the calculation in determining the point in time at which to feed the supplementary value. This avoids, for example, a delay in the preloading of the rotational speed regulator which would be disadvantageous for the functioning of the method.

Here, it is particularly of advantage if, in determining the point in time at which to feed the supplementary value, delays in the rotational speed regulator and the drives are taken into account. These include, for example, the moments of inertia of the drive, such as for example the current rise time for the motor. In other words: the time point for the feeding is corrected according to the duration of the delay, so that the supplementary value is fed out at an earlier point in time corresponding to the duration of the delay. In this case, the supplementary value is thus ideally fed out at a point in time which depends on the point in time of the load imposition such that the corresponding torque from the drives, resulting from the supplementary value, is effected at precisely the point in time at which the real load moment arises.

In the case of one further advantageous embodiment, the supplementary value concerned is adjusted during the processing of the material being rolled, using correction factors. At the start of the processing, the correction factors of the individual supplementary values are equal to one. In subsequent refinement steps, the individual correction factors are modified appropriately. In this way, the set values of the I-components for each drive can be made trimmable. By appropriate modification of the correction factors it is possible, for example, to compensate for different levels of wear of the roll stands and calibrated rolling rings, but also for inaccuracies in the pass plan calculations.

The second objective mentioned is achieved by a rolling line for processing material to be rolled. The rolling line incorporates at least one rolling section having at least two roll stands each with at least one roll, wherein each roll stand has assigned to it a separate drive with a rotational speed regulator for the at least one roll, and a control/regulation unit in which is implemented software for carrying out the methods disclosed herein.

The properties, characteristics and advantages of this invention, described above, together with the manner in which these are achieved, will be clearer and more plainly understandable in conjunction with the following description of the exemplary embodiments, which are explained in more detail in conjunction with the drawings.

BRIEF DESCRIPTION OF THE DRAWINGS

For a further description of the invention, reference is made to the exemplary embodiments in the drawings. Shown in a schematic sketch of the principle are.

DESCRIPTION OF EMBODIMENTS

Figure 1:
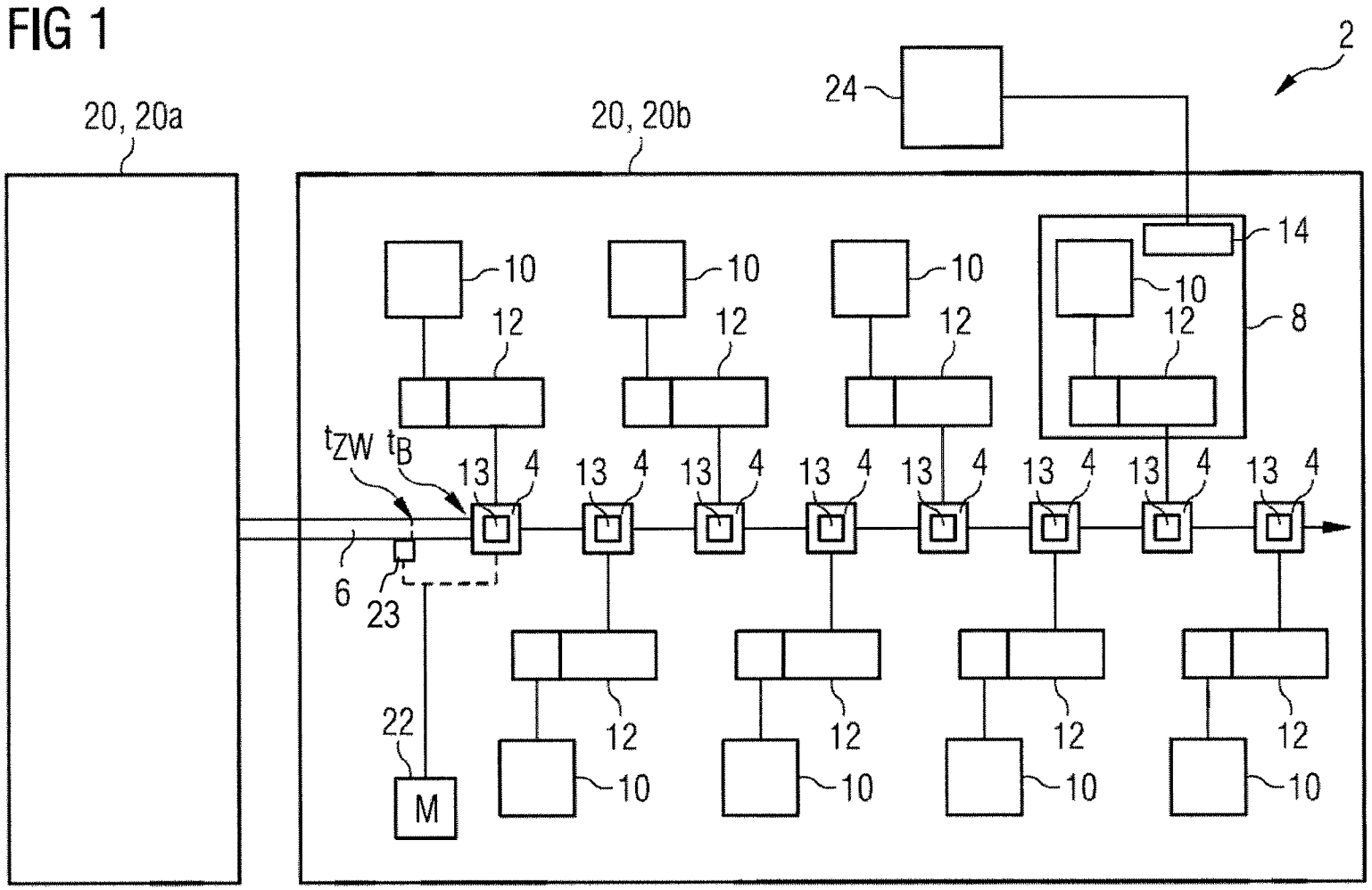
FIG. 1 schematically represents a section of a rolling line with successive roll stands and with a separate drive for each roll stand.

FIG. 1 shows a section of a rolling line 2 with two rolling sections 20, e.g. an intermediate section 20*a* and a finishing section 20*b*. A rolling section 20 incorporates at least two roll stands 4 each with at least one roll 13, e.g. two rolls 13, for the processing of a material to be rolled 6. FIG. 1 shows, by way of example, eight successive roll stands 4, for the sake of clarity only illustrating those for the finishing block 20*b*, of a rolling section 20 through which passes the material to be rolled 6, e.g. a billet which is being rolled down to wire.

Assigned to each roll stand 4 is a separate drive 8, incorporating a motor 10 and a gearbox 12, with a rotational speed regulator 14 which, for the sake of clarity, in FIG. 1 is only drawn in for one roll stand 4. The rotational speed regulator 14 regulates the rolls 13 of the drive 8 concerned to a setpoint value, $n_{Soll}$, for the rotational speed. For this purpose, an actual value of the rotational speed, $n_{Ist}$, is continuously sensed by the rotational speed regulator 14 of the drive 8, is compared with the setpoint value for the rotational speed, $n_{Soll}$, which is determined e.g. by reference to a pass plan, and is adjusted to it. For the purpose of control and regulation by the rotational speed regulator 14, the rolling line 2 incorporates a control/regulation unit 24—also shown for only one roll stand 4—in which is implemented software for carrying out the method.

Figure 2:
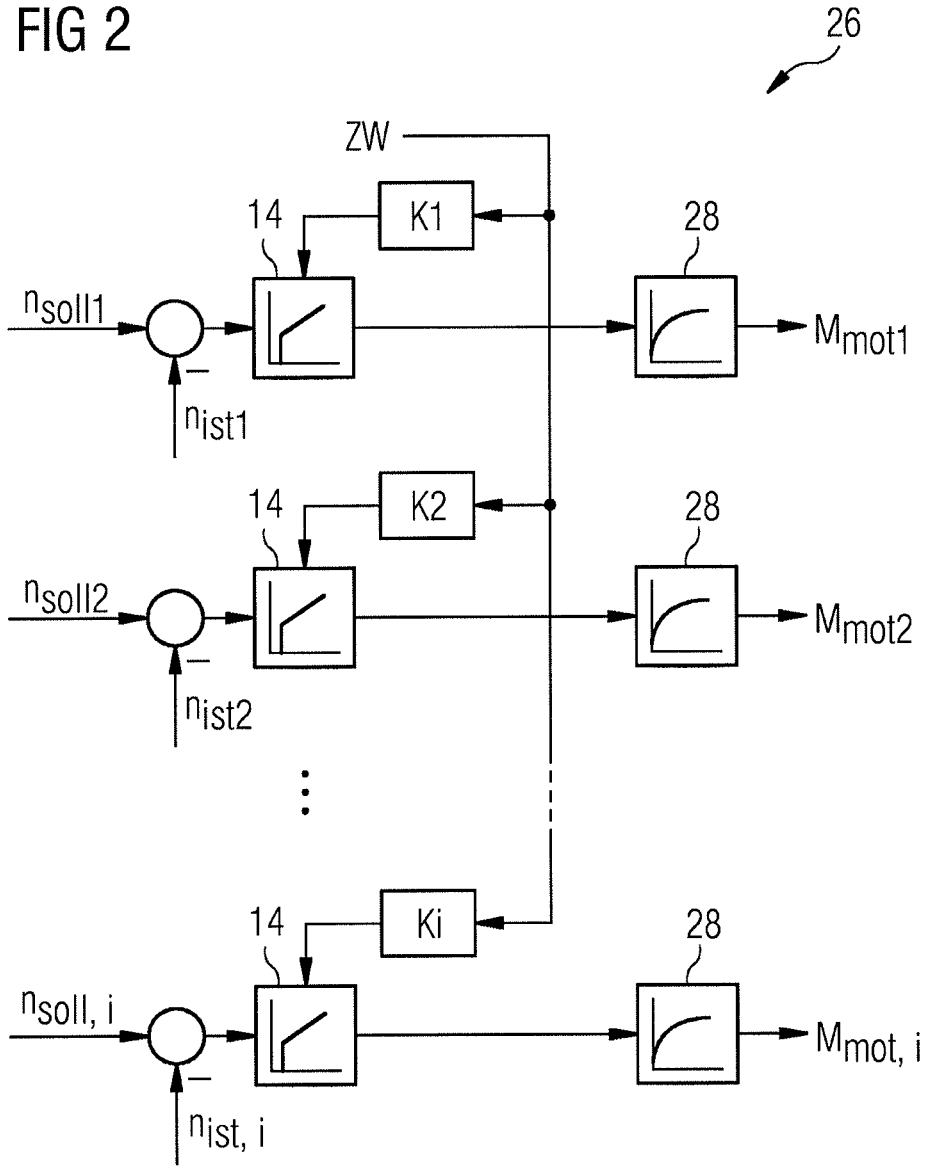
FIG. 2 is a schematic representation of a rotational speed regulation for the drives on the rolling line.

FIG. 2 shows a rotational speed regulator 26, for a rolling section 20 with several roll stands 4, for regulating the rotational speeds $n_{Ist,i}$ of all the drives 8, and thus of the rolls 13 of the roll stands 4 in the rolling section 20, e.g. of the finishing section 20*b*. Assigned to each drive 8 is a rotational speed regulator 14, which incorporates a PI-regulator, which senses and regulates a difference to be regulated between the actual value of the rotational speed $n_{Ist,i}$ and the setpoint value for the rotational speed $n_{Soll,i}$. In addition, the rotational speed regulator 26 incorporates for each drive 8 a current or torque regulation loop 28, as appropriate, which supplies the motor 10 with current and controls it to a desired operating point, and which in its regulation takes into consideration the moments of inertia of the drive.

At a point in time $t_B$, the first roll stand 4 of the rolling section 20 has imposed on it a real load moment. At a time point $t_{zw}$, which depends on this time point $t_B$, a supplementary value ZW, which depends on the expected real load moment, is fed to the rotational speed regulator 14 of each drive 8 for the purpose of regulating the rotational speeds of the drives 8. So all the drives 8 are preloaded with a supplementary value ZW at a point in time $t_{zw}$, which has been determined as a function of the time point $t_B$ and which lies, for example shortly before, at, or shortly after the time point $t_B$ of the load imposition. This is fed to the relevant PI-regulator of the drive 8 concerned, as a preloading of the I-component. Thus at the time point $t_{zw}$ the relevant supplementary value ZW is fed to each drive 8, or to the relevant rotational speed regulator 14, as appropriate. By this means, a drop in the rotational speed, that is a reduction in the actual rotational speed $n_{Ist,i}$, at all the roll stands 4 is decreased or largely avoided, so that the ratio of the rotational speeds of the individual roll stands 4, to each other and to the last roll stand in the rolling section 20*a*, remains constant.

The expected real load moment and the supplementary value ZW concerned are here determined by reference to a pass plan and are fed to the PI-regulator of the relevant rotational speed regulator 14 at a time point $t_{zw}$. After the preloading of the I-component with the supplementary value, in the next cycle of the system the rotational speed regulator 14 is released again and regulates the difference to be regulated, between the actual value of the rotational speed $n_{Ist,i}$ and the setpoint value of the rotational speed $n_{Soll,i}$.

In order to determine the time point $t_B$ at which the load is imposed, there is a measurement device 22, as shown in FIG. 1. Using this measurement device 22, the time point $t_B$ at which the load is imposed on the first roll stand 4 is determined from the actual load moment, for example by reference to a measurement of the rolling force M. The measurement device 22 for measuring the rolling force is constructed as a strain gauge, which is arranged in the first roll stand 4.

In addition, the time point $t_B$ at which the real load moment is imposed on the first roll stand 4 is determined by means of material tracking. For this purpose, the measurement device 22 has a "hot metal detector" 23, which is arranged before the first roll stand 4 and which detects the point in time at which it is passed by the material being rolled 6. The point in time $t_B$ at which the real load moment will be imposed on the first roll stand 4 is thus determined even before the material being rolled 6 enters into the first roll stand 4 of the rolling section 20. The time point $t_{zw}$ is then determined as a function of the point in time $t_B$ at which the real load moment is imposed on the first roll stand 4. At the time point $t_{zw}$, the material being rolled 6 is, as indicated in FIG. 1 by dashed lines, still before the first roll stand 4.

In determining the time point $t_{zw}$ as a function of the time point $t_B$, account is also taken of delays, for example, the moment of inertia of the motor torque $M_{mot,I}$ as it rises, which typically causes a delay of 10 to 50 ms. Correspondingly, the feeding of the supplementary value ZW takes place at a time point $t_{zw}$ which lies shortly before the point in time $t_B$ of the imposition of the load. Because a relevant supplementary value ZW is fed to all the rotational speed regulators 14, a drop in the rotational speed, when the material being rolled 6 enters the first roll stand 4 of a rolling section 20, is minimized at all the drives 8. This ensures the synchronicity of the individual roll stands 4 in the rolling section 20*b* and of the last stand of the rolling section 20*a*, that is, the ratio of their rolling speeds to one another, when the material being rolled 6 enters the rolling section 20*b*. Hence, a rotational speed ratio for the roll stands 4, prescribed in the pass plan, remains constant during the entire processing of the material being rolled 6. By this means, loop formation between the individual roll stands 4 of a rolling section 20, and between the rolling sections 20*a* and 20*b*, is prevented.

Furthermore, during the processing of the material being rolled 6 the relevant supplementary value ZW is adjusted by reference to correction factors $K_i$, by which means the supplementary values can still be trimmed for each drive, and can thereby be made a better match by eliminating incalculable effects from contamination.

Although the invention has been illustrated and described in more detail by the preferred exemplary embodiment, the invention is not restricted by the examples disclosed, and other variations can be derived from it by a person skilled in the art without going outside the scope of protection of the invention.

The invention claimed is:

1. A method for rolling materials to be processed in an advancing direction on a rolling line wherein the rolling line includes at least one rolling section, each rolling section having at least two roll stands arranged in the advancing direction, each roll stand having at least one roll configured and operable for enabling movement of the materials in the advancing direction;

a separate respective drive with a rotational speed regulator for the at least one roll of each roll stand for moving the materials in the advancing direction;

the method comprising:

determining a first point in time at which a real load moment is imposed on the drive of the first roll stand by material tracking of the material being rolled; and at a second point in time, which depends on the first time point at which the real load moment caused by the materials moving in the advancing direction is imposed on the drive of the first roll stand in the rolling section, feeding a supplementary value, which is a function of an expected real load moment, to the rotational speed regulator of each drive, wherein the feeding of the supplementary value is simultaneous with the rotational speed regulator of the drive of the first roll stand and with the rotational speed regulators of the drives of the subsequent roll stands in a same rolling section such that the supplementary value regulates the rotational speed regulators to regulate the rotation speeds of the drives.

2. The method as claimed in claim 1, wherein the rotational speed regulator incorporates a PI-regulator and the method further comprising feeding the supplementary value as preloading of an I-component of the PI-regulator.

3. The method as claimed in claim 2, further comprising determining the expected real load moment and the supplementary value by reference to a pass plan for processing the materials.

4. The method as claimed in claim 1, wherein:

determining said second point in time for feeding said supplementary value to the rotational speed regulator of each said drive takes into account delays in the rotational speed regulator and in the drives.

5. A method for rolling materials to be processed in an advancing direction in a rolling line wherein the rolling line includes at least one rolling section, each rolling section having at least two rolling stands arranged in the advancing direction, each roll stand having at least one roll configured and operable for enabling movement of the materials in the advancing direction;

a separate respective drive with a rotational speed regulator for the at least one roll of each roll stand for moving the materials in the advancing direction;

the method comprising:

determining a first point in time at which the real load moment is imposed on the drive of the first roll stand by reference to a measurement of a rolling force at the first roll stand; and at a second point in time, which depends on the first time point at which the real load moment caused by the materials moving in the advancing direction is imposed on the drive of the first roll stand in the rolling section, feeding a supplementary value, which is a function of an expected real load moment, to the rotational speed regulator of each drive, wherein the feeding of the supplementary value is simultaneous with the rotational speed regulator of the drive of the first roll stand and with the rotational speed regulators of the drives of the subsequent roll stands in a same rolling section such that the supplementary value regulates the rotational speed regulators to regulate the rotational speeds of the drives.

6. The method as claimed in claim 5, further comprising: determining the point in time at which the real load movement is imposed on the drive of the first roll stand by using a strain gauge for measuring the rolling force.

7. A rolling line for the processing of materials to be rolled, the rolling line comprising:

at least one rolling section having at least two roll stands, and each roll stand having at least one roll; and a separate drive with a rotational speed regulator configured for driving and regulating the at least one roll of each roll stand; and a control/regulation unit configured and operable for controlling the speed regulators for the rolls such that at a first point in time at which a real load moment caused by the materials moving in an advancing direction is imposed on the drive of the first roll stand in the rolling section determined by material tracking of the material being rolled by one or more hot metal detectors, and at a second point in time which depends on the first time point, feeding a supplementary value, which is a function of an expected real load moment, to the rotational speed regulator of each drive, wherein the feeding of the supplementary value is simultaneous with the rotational speed regulator of the drive of the first roll stand and with the rotational speed regulators of the drives of the subsequent roll stands in a same rolling section such that the supplementary value regulates the rotational speed regulators to regulate the rotation speeds of the drives.

8. A rolling line for the processing of materials to be rolled, the rolling line comprising:

at least one rolling section having at least two roll stands, and each roll stand having at least one roll; and a separate drive with a rotational speed regulator configured for driving and regulating the at least one roll of each roll stand; and a control/regulation unit configured and operable for controlling the speed regulators for the rolls such that at a first point in time at which a real load moment caused by the materials moving in an advancing direction is imposed on the drive of the first roll stand in the rolling section determined by material tracking of the material being rolled by a measurement device for measuring the rolling force on the first roll stand, at a second point in time which depends on the first time point, feeding a supplementary value, which is a function of an expected real load moment, to the rotational speed regulator of each drive, wherein the feeding of the supplementary value is simultaneous with the rotational speed regulator of the drive of the first roll stand and with the rotational speed regulators of the drives of the subsequent roll stands in a same rolling section such that the supplementary value regulates the rotational speed regulators to regulate the rotation speeds of the drives.

* * * * *